US005885119A

United States Patent [19]

Schmid et al.

[11] Patent Number: 5,885,119

[45] Date of Patent: Mar. 23, 1999

[54] MULTIPOLE ELECTRICAL PLUG CONNECTOR

[75] Inventors: Roland Schmid, Dettingen; Reinhold Jocham, Hechingen, both of Germany

[73] Assignee: Robert Bosch GmbH, Stuttgart, Germany

[21] Appl. No.: 638,613

[22] Filed: Apr. 26, 1996

[30] Foreign Application Priority Data

May 27, 1995 [DE] Germany ..... 295 08 805.2 U

[51] Int. Cl.[6] ..... H01R 9/24

[52] U.S. Cl. ..... 439/885; 439/891

[58] Field of Search ..... 439/885, 891; 29/874, 884

[56] References Cited

U.S. PATENT DOCUMENTS 5,226,840 7/1993 Wojtanek ..... 439/733.1

5,340,337 8/1994 Pentz ..... 439/885

5,539,978 7/1996 Vanbesien ..... 29/884

FOREIGN PATENT DOCUMENTS 2093641 1/1982 United Kingdom ..... 439/891

*Primary Examiner*—Neil Abrams
*Assistant Examiner*—Barry M. L. Standig
*Attorney, Agent, or Firm*—Michael J. Striker

[57] ABSTRACT

A multipole electrical plug connector for a releasable coupling with a counter-connector has a contact set including a plurality of contact elements each having a contact portion and a connecting portions, the connecting portions of the contact elements being formed as part of a one-piece punched grate with a thickness which is independent from a thickness of the contact portions which is joined with the connecting portions.

9 Claims, 1 Drawing Sheet

MULTIPOLE ELECTRICAL PLUG CONNECTOR

The present invention relates to a multipole electrical plug connector.

Electrical plug connectors of the above mentioned general type are known. in the art. A known plug connector has a plurality of contact elements which, in view of the place to be occupied, are arranged in several rows and spaced from one another in a direction which is transverse to the rows so as to form gaps therebetween.

During the manufacture of contact elements the contact portions of the contact elements which in a cross-section are rectangular, elongated and flat and narrow at their free end to form so-called cutter, extend from a metal plate with a thickness corresponding to the thickness of each contact portion, since the thickness of the contact portion is decisive for stabilization reasons for the dimensioning of the contact element. Under the action of the plunging process and in some cases also bending process with formation of a punched grate, the contact elements are formed from the metal plate. They are separated from one another by punched gaps which later form lateral distances within a row of the contact elements. The contact elements are fixed in their position relative to one another by lateral removable transverse webs, in a one piece, easily handled punched grate for a row of contact elements. For each contact element a punched grate is needed and several punched grates are assembled to a contact set for the plug connector.

After a partial synthetic plastic injection molding of all contact elements of the contact set, it is the synthetic plastic injection molding performing the function of the contact support, the transverse webs are removed and the contact elements are electrically separated from one another.

When such a plug connector is a control device as an integrated plug, in the functions of the control device accomplished by hybrid circuit or multi-chip module (MCM) in these cases in the event of high operational region of the control device the size of the control device might be determined no longer by its switching element but instead by the number of the contact elements. This however must be avoided.

SUMMARY OF THE INVENTION

Accordingly, it is an object of the present invention to provide a multipole electrical plug connector which avoids the disadvantages of the prior art.

In keeping with these objects and with others which will become apparent hereinafter, one feature of the present invention resides, briefly stated, in a multipole electrical plug connector with which the connection portions of the contact element are formed from a one-piece punched grate with a thickness independent from the thickness of the contact portion joined with the connection portions.

When the multipolar electrical plug connector is designed in accordance with the present invention, it eliminates the above mentioned deficiencies and provides for the highly advantageous results. The connection portions of the contact element which guide two connecting points of the circuit element of the control device, for all contact elements are produced from a one-piece punched grate whose thickness is not dependent from the thickness of the contact portions. The connecting portion of the contact elements are, being guided separately, joined with the connecting portions. Therefore such a multipole electrical plug connector is formed which can be especially small and produced in an inexpensive manner.

This is achieved in particular by the fact that the punched grate serves only for the manufacture of the connecting portions of the contact elements and the contact portion of the contact elements with their massive thickness deviating from the thickness of the punched grate are joined as separate parts with the connecting portions. With the utilization of the punched grate for all contact elements arranged in several rows, the narrower distances between the contact elements can then be made during the assembly of the contact sets from several punched grates.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
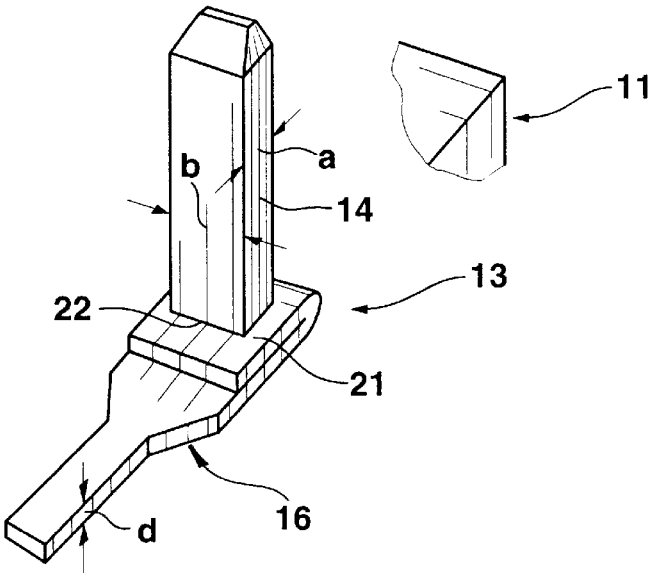
FIG. 1 is a view showing an individual contact element of a plug connector in accordance with the present invention.
Figure 2:
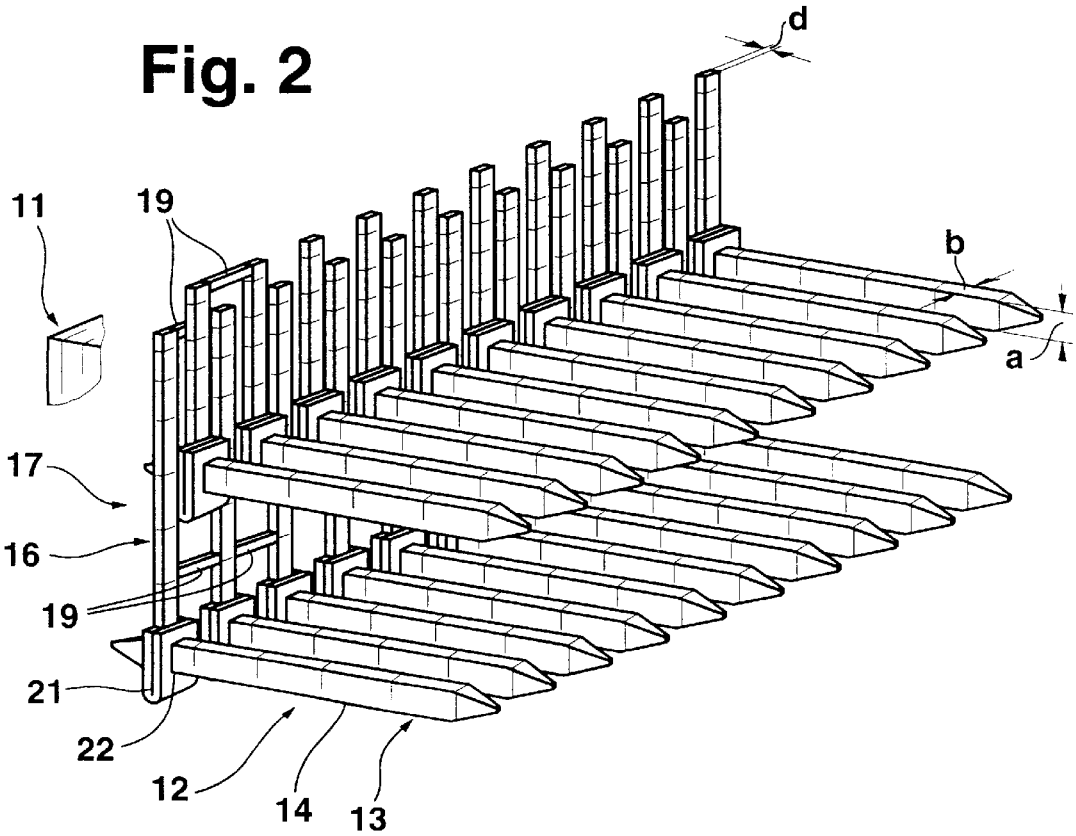
FIG. 2 is a view showing a contact set of a multipole electrical plug connector in accordance with the present invention.

A plug connector shown in FIGS. 1 and 2 is identified as a whole with reference numeral 11. It is a part of an electrical plug connection and provided for releasable coupling with a not shown counter-plug.

A plug connector 11 has a contact set 12 supported in a not shown manner. The contact set has a plurality of contact elements 13 which are arranged in two or more rows parallel to one another. Each contact element 13 has a contact portion 14 and a connecting portion 16.

The contact portion 14 is composed essentially of a longitudinally extending parallalepiped-shaped body. Its rectangular cross-section has a width b which substantially corresponds to the thickness a. The contact portion 14 is pointed at its free end for facilitating contacting with a counter-contact of the counter-plug formed as a spring bushing.

The contact portion 14 alternatively can be formed as a longitudinally extending body with a square or round cross-section.

The connecting portion 16 of the contact elements 13 are flat, web-shaped bars with the thickness d. They are produced from a metal plate of the same thickness by a punching process with formation of a punched grate 17 shown in FIG. 2. The longitudinally drawn connecting portions 16 are formed in this punched grate 17 by punched gaps which separate the connecting portions from one another. The connecting portions 16 are connected with one another by means of transverse webs 19 so as to form a one-piece unit in form of the punched grate 17, which is easy to handle for further manufacture of the plug connector 11.

The connecting portions 16 serve as bridges between a connecting point of a switching element of a control device and a contact portion 14. The connecting portions at the end facing the associated contact element 13 is provided with a joining region 21 for receiving the contact portion 14. In the shown embodiment the end of each connecting portion 16 is folded, so that the joining region 21 has the double thickness d of the connecting portion 16.

A receptacle 22 is provided in each joining region 21 and extend perpendicular to the folded surfaces. The associated contact portion 14 is pressed from one side in the receptacle 22. By the folding, the receptacle 22 in the joining region has an increased guiding length L, when compared to the thickness d of the other region of the connecting portion 16. Therefore a stable-pre-fixing of the contact portion 14 on the connecting portion 16 is provided.

This increased guiding length can be obtained also in a non-folded joining region 21, in that the receptacle 22 is formed by a suitable process for example punching. For increasing the guiding length, the receptacle 22 can be formed as a passage by a deep drawing process.

The final fixing of the contact portion 14 extending transverse to the joining region 21 with the connecting portion 16 is performed by a material connection in the region of the receptacle (see FIG. 3) 22, for example by laser welding or soldering.

In order to complete the plug connector 11, the punched grate 17 is provided in a not shown manner with a synthetic plastic coating as a contact carrier. By a removal of the transverse web 19 of the punched grate 17, the contact elements 13 which are held by the synthetic plastic coating and are electrically separated from one another are released, and the thusly produced contact set 12 is inserted in the housing and fixed there.

Alternatively to the production of the contact carrier by synthetic plastic coating, the punched grate 17 can be also inserted in a synthetic plastic carrier and fixed there by a suitable process, for example ultrasound. As a result, the multipole electrical plug connector 11 is provided in which the contact elements 13 arranged especially close to one another. Therefore, the plug connector can be formed with a plurality of contact elements 13 at the same time have a small size.

Because of the one piece punched grate 17 for all contact elements, the plug connector 11 can be produced inexpensively. In particular, when the plug connector 11 is provided with different contact portions 14, for example thin contact portions 14 for the signal transmission and wide contact portions 14 for a current connection, the advantages of the inventive punched grate 17 with a thickness independent from the thickness of the contact portions 14 are especially important. With a punched grate 17 which is thin walled when compared with the contact portion 13, a small punched web 18 and thereby a fine division of the connecting portions 16 of the contact elements 13 is obtained. The fine division of the connecting portions 16 is performed in particular by their close location for the contacting of the switching element.

By joining of the connecting portions 16 formed from the punched grate 17, with the separate contact portions 14 produced from band or wire zinc plated material to form the contact elements 13, considerably narrower distances between the contact elements can be obtained than in a multi-row conventional plug connector 11 in which the contact portions 14 are directly produced from the punched grate 17 together with the connecting portions 16. The reason is that the development of the contact portions 14 from the punched grate 17 is no longer decisive for the distances between the contact elements 14.

It will be understood that each of the elements described above, or two or more together, may also find a useful application in other types of constructions differing from the types described above.

While the invention has been illustrated and described as embodied in a multipole electrical plug connector, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A multipole electrical plug connector for coupling with a counter-connector, the plug connector comprising a contact set including a plurality of contact elements each having a contact portion and a connecting portion, said connecting portion of said contact elements being formed as a part of a one-piece punched grate which is separate from said contact portion and therefore has a thickness which is independent from a thickness of said contact portion, said connecting portion of said contact elements having joining regions and being provided in said joining region with a punched receptacle for receiving said contact portion of said contact elements, said contact portion being joined with said connecting portion by a partial press fit of said contact portion in said receptacle of said connecting portion.

2. A multipole electrical plug connector as defined in claim 1, wherein said punched grate has a thickness which is smaller than a thickness of said contact portion.

3. A multipole electrical plug connector as defined in claim 1, wherein said connecting portion of said contact elements is folded in said joining regions.

4. A multipole electrical plug connector as defined in claim 1, wherein said connecting portion joined with said contact portion in a joining region by an uninterrupted material connection.

5. A multipole electrical plug connector as defined in claim 4, wherein said material connection is formed as a laser welding seam.

6. A multipole electrical plug connector as defined in claim 4, wherein said material connection is formed as a soldering seam.

7. A multipole electrical plug connector as defined in claim 1, wherein said contact portion of said contact elements is formed as plug pins composed of band-shaped zinc coated material.

8. A multipole electrical plug connector as defined in claim 1, wherein said contact portion of said contact elements are formed as plug pins composed of a wire shaped zinc coated material.

9. A multipole electrical plug connector for coupling with a counter-connector, the plug connector comprising a contact set including a plurality of contact elements each having a contact portion and a connecting portion, said connecting portion of said contact elements being formed as a part of a one-pieced punched grate which is separate from said contact portion and therefore has a thickness which is independent from a thickness of said contact portion, said connecting portion of said contact elements having joining regions and being provided in said joining regions with a punched receptacle for receiving said contact portion of said contact elements, said contact portion being joined with said connecting portion by a partial press fit of said contact portion in said receptacle of said connecting portion, said connecting portion and said contact portion of each of said contact elements being formed as separate members which are connected with one another by an uninterrupted material connection selected from the group consisting of a welding seam and a soldering seam.

* * * * *